United States Patent [19]

Stewart, Jr.

[11] Patent Number: 4,903,932

[45] Date of Patent: Feb. 27, 1990

[54] CLIP BOARD

[76] Inventor: Isaac Stewart, Jr., 1512 Bonvillain St., Houma, La. 70360

[21] Appl. No.: 180,123

[22] Filed: Apr. 11, 1988

[51] Int. Cl.[4] ..... A47B 17/00

[52] U.S. Cl. ..... 248/444; 24/3 A; 24/482; 248/451; 248/452; 248/453; 248/558; 281/45; 281/15.1; 403/4

[58] Field of Search ..... 248/444, 451, 452, 453, 248/558; 281/1, 15 A, 15 B, 45; 403/292, 306, 311, 4; 24/3 A, 482, 67.11, 67 R, DIG. 8, 67.3

[56] References Cited

U.S. PATENT DOCUMENTS

| | | | |
|---|---|---|---|
| 259,142 | 6/1882 | Hart | 248/513 |
| 742,395 | 10/1903 | Colleen | 248/453 X |
| 1,894,559 | 1/1933 | Fisher | 248/444 |
| 2,701,173 | 2/1955 | Senior et al. | 248/444 X |
| 2,876,022 | 3/1959 | Kroviak | 248/444 X |
| 3,586,306 | 6/1971 | Reece | 248/188.2 |
| 3,787,014 | 1/1974 | Stury et al. | 248/558 |
| 4,243,249 | 1/1981 | Goss | 248/444 |

FOREIGN PATENT DOCUMENTS

| | | | |
|---|---|---|---|
| 557656 | 1/1975 | Switzerland | 248/452 |
| 14151 | of 1897 | United Kingdom | 281/45 |
| 11758 | of 1907 | United Kingdom | 428/451 |

*Primary Examiner*—David L. Talbott
*Attorney, Agent, or Firm*—Keaty & Keaty

[57] ABSTRACT

The invention relates to devices for rotating documents in place, such as clip boards, in the absence of tables, desks and similar supports. A writing tablet is secured to a thigh of a user, while seated by a belt which wraps about the thigh of a user and the ends of which are locked by a buckle or Velcro® strips. Positioning of the writing tablet in relation to the belt can be varied by rotating the writing tablet in relation to the belt and, after the most convenient position for the user has been selected, the writing tablet is locked in that position in relation to the belt.

10 Claims, 3 Drawing Sheets

CLIP BOARD

BACKGROUND OF THE INVENTION

1. Field of the Invention

This invention relates to devices for retaining documents in place and allowing writing in the absence of tables, desks and similar supports. Even more specifically, the present invention relates to clip boards for providing a support surface for paper to be placed thereon and retaining the paper in a predetermined position on a user's lap.

When taking notes in an auditorium which lacks writing supports, when taking notes outdoors or while travelling, one often encounters numerous inconveniences in trying to provide a sturdy even surface, on which a sheet of paper or a note pad can be positioned, when conventional writing supports, such as tables or desks are unavailable.

For this purpose, clip boards are often used to provide such a smooth surface and to at least partially eliminate inconveniences encountered by those attempting to write while seated. But a conventional clip board often shifts its position on the lap of a user and needs to be manually held in place.

Further inconveniences are encountered when a person is attempting to make notes or to draw sketches outdoors, with the wind blowing the pages away.

There are numerous devices to alleviate some of the inconveniences associated with using a standard clip board, while attaching it to an upper arm or a thigh of a user.

One of such examples is U.S. Pat. No. 4,243,249 issued to H. Calvin Goss on Jan. 6, 1981 for "Document Holder Assembly". That holder is provided for use by a pilot or navigator and includes a releasable strap fastener to attach a molded concave surface of a support base onto the top thigh portion of a pilot or navigator while seated. A carrier plate, resembling a standard clip board, is permanently connected by a centrally located pivot to the support base. A pair of clamps positioned in the top and side portions of the carrier plate are designed to secure the documents along two adjoining sides of the carrier plate, to enable orientation by rotation of the plate.

Another example of modification of a standard clip board is shown in U.S. Pat. No. 2,876,022 issued on Mar. 3, 1959 to J. E. Kroviak and entitled "Clip Board Attachment". The attachment provides for the use of an arm strap made of elastic material and held onto a standard clip board by anchors mounted on diagonally opposite corners of the clip board. The elastic strap is secured under tension under the clip board.

While providing considerable advantages over standard clip boards, the above clip board modifications still suffer from various disadvantages: for example, there are no means provided to hold a bottom portion of a sheet of paper and prevent it from being blown by the wind or to hold a turned over page of a writing pad, without it interferring with writing on the next page.

Additionally, it is impossible to secure a clip board in any angular position most convenient to the user while writing.

It is, therefore, an object of the present invention to provide a clip board which is easily attachable to a thigh of a user while seated.

It is a further object of the present invention to provide a clip board with a writing tablet rotationally adjustable in one plane and lockable in any desired position.

It is still a further object of the present invention to provide a clip board having means for securing a sheet of paper on all four sides thereof.

It is another object of the present invention to provide a clip board having means to secure a folded over page of a writing pad beneath the writing tablet, if necessary.

These and other objects of the present invention will be apparent to those skilled in the art from the following description of the invention.

SUMMARY OF THE INVENTION

The present invention overcomes shortcomings of the prior art and achieves its objects in a simple and straightforward manner.

The clip board is provided with means for attaching a writing tablet to a thigh of the user while seated, while allowing selected positioning of the writing tablet in relation to the attachment means which remain stationary when the clip board is in use. An elastic band is wrapped around an upper portion of the writing tablet and a similar elastic band is wrapped and stretched about the lower portion of the writing tablet to secure paper on top and bottom of the paper sheet. A pair of side paper holders are attached diagonally at opposite corners of the writing tablet for pivotal movement between a first position and a second position, when the side holders extend along the sides of the writing tablet for pressing the sheet of paper down on the writing tablet on the sides of the paper sheet.

DESCRIPTION OF THE PREFERRED EMBODIMENT

Figure 1:
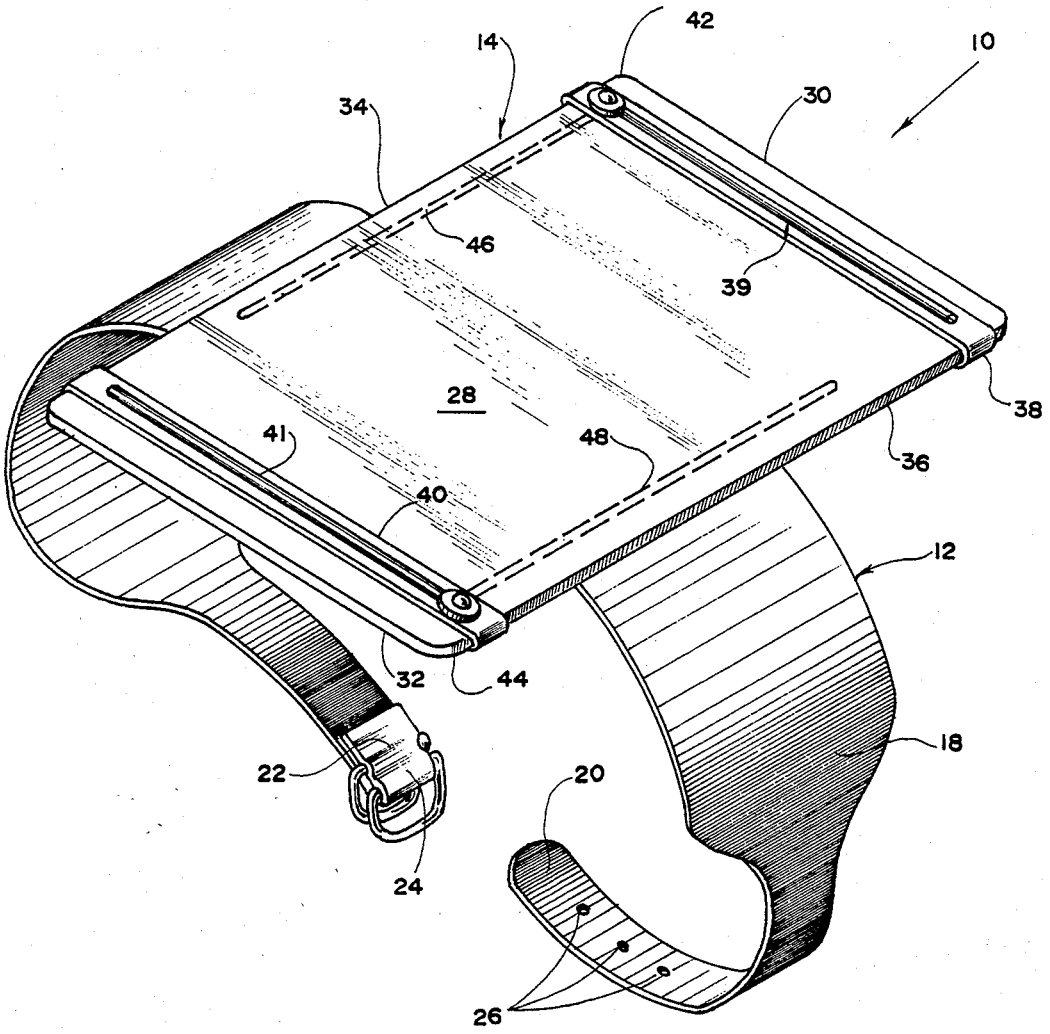
FIG. 1 is a perspective view of the clip board in accordance with the present invention.
Figure 2:
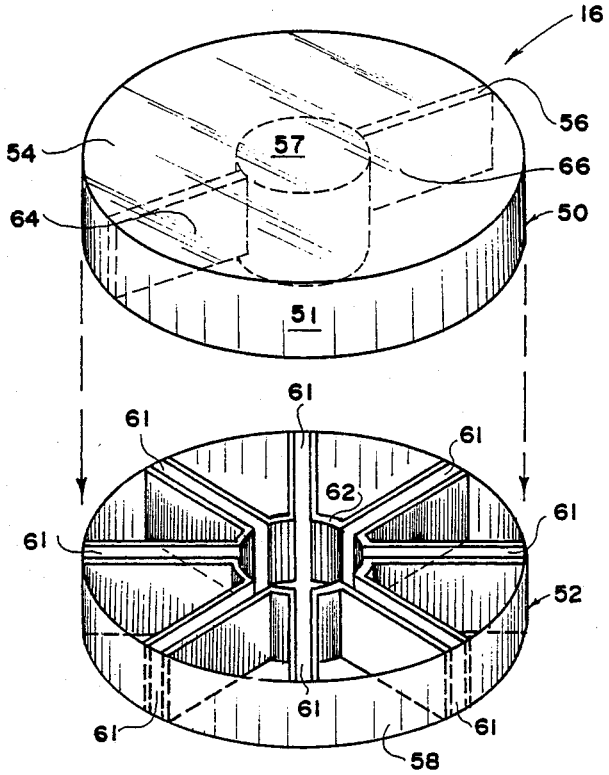
FIG. 2 is an exploded view showing adjustable means for securing writing tablet to the clip board attachment means.

Referring now to the drawings in more detail, the clip board in accordance with the present invention is generally designated by numeral 10. The clip board 10 comprises an attachment means 12 and a writing tablet 14. The writing tablet 14 is secured to the attachment means 12 by suitable adjustment means 16 allowing angular positioning of the writing tablet 14 in relation to the attachment means 12.

The attachment means 12 is formed by a flexible belt 18 having opposing distant ends 20 and 22.

The end 20 is provided with a number of spaced-apart apertures, while end 22 is provided with a suitable fastening buckle having a pin 24 for inserting through one of the apertures 26 formed in the end 20 of the belt 18.

Alternatively, the opposing ends 20 and 22 can be provided with hook and loop fasteners, such as Velcro® strips, to facilitate positioning and removal of the attachment means 12 from a thigh of a user.

Flexible material of the attachment means 12 allows for easy adjustment of the belt to the natural curvature of a human thigh of the user while he is seated. The belt 18 can also serve as a carrying handle, if needed. In that case, books, note pads and the like can be positioned on the writing tablet 14 and the belt 18 is lifted upward, over a stack of books, etc. placed on the writing tablet 14 and the ends 20 and 22 are locked together, tightening the stack and allowing the clip board 10 to be carried by handle/belt 18.

The writing tablet 14 has a generally rectangular shape and can be of any required size for easy adaptation of the clip board to various sizes of paper or note pads.

The top surface 28 of the writing tablet 14 is made smooth and sufficiently hard to allow easy writing on a sheet of paper positioned on the top surface 28.

For ease of description, one short end of the writing tablet 14 will be designated as the top 30 of the tablet, with the opposing short end being designated as the bottom 32 of the tablet, while the longer sides of the writing tablet 14 will be designated as first 34 and second 36 sides of the writing tablet 14.

Mounted adjacent the top end 30 of the tablet 14 is a stretchable elastic securing means 38, which stretches the width of the writing tablet 14 and wraps around the bottom surface 29 of the writing tablet 14. The stretchable band 38 can be slidably adjusted along sides 34 and 36 of the tablet 14 to adapt for different longitudinal dimensions of a sheet of paper positioned atop an upper surface 28 of the tablet 14.

A similar stretchable band 40 is mounted adjacent the bottom end 32 of the tablet 14 and, likewise, can be slidably moved along sides 34 and 36 to secure a bottom portion of the sheet of paper positioned on the tablet 14.

The stretchable bands 38 and 40 are each provided with an elongated opening 39 and 41, respectively, the purpose of which will be described hereinafter.

Attached diagonally at opposing corners 42 and 44 of the writing tablet 14 are wire holders 46 and 48, respectively. The holders 46 and 48 are pivotally adjustable between a first position, wherein the wires extend substantially parallel to the stretchable bands 38 and 40, within the openings 39 and 41, and a second position when the holders are moved to extend in parallel to the first and second sides 34 and 36, thus pressing the paper positioned on the top surface 28 of the writing tablet 14, and at least in part counteracting the force of wind or the like, attempting to remove the sheet of paper from the top surface 28 of the tablet 14.

The wire holders 46 and 48 can be attached in any suitable manner, such as for example, by bolts, passing through apertures made in the writing tablet 14.

The adjustment means 16 by which the attachment means 12 is attached to the writing tablet 14 can be made in the form of a "lazy susan" mechanism by "sandwiching" steel or plastic rollers o ball bearings between two plates. But instead of a free rotation of the tablet 14 about an axis, the adjustment means are provided with locking elements allowing locking of the writing tablet in a desired specific orientation in relation to the attachment belt 18 which remains stationary when attached to the user's tigh at the most convenient position to the user. The locking element, in one of the embodiments, comprises a pair of cylindrical sleeves 50, 52, one of which will be attached to the central portion of the writing tablet 14, while another sleeve will be fixedly attached to the belt 18. The cylindrical sleeve 50 attached to the tablet 14 has a closed bottom 54, from which a rib 56 vertically extends, the rib spanning the diagonal space of the sleeve. A closed bottom 58 of the sleeve 52 is provided with an insert 60 forming a plurality of grooves 61 extending from a central hub 62, dividing the annular space within the sleeve 52 into a plurality of segments, which are preferably of the same size. The grooves 61, spanning diagonally in the sleeve, are adapted to frictionally engage the rib 56, so as to lock the writing tablet 14 in the predetermined disposition in relation to the belt 18.

Mounted inside the sleeve 50 is a cylindrically shaped post 57 to which the rib 56, comprised of two sections 64 and 66, is attached. The sections 64 and 66 extend from the post 57 in diametrically opposite direction towards the vertical wall 51 of the sleeve 50. The diameter of the post 57 is slightly smaller than the diameter of the hub 62, while the vertical dimension of the post 57 is slightly greater than the vertical dimension of the hub 62. The diameter of the sleeve 50 is greater than the diameter of the sleeve 52, the reason for which will be explained in more detail hereinafter.

In operation, the sleeve 50 is engaged with sleeve 52 by moving the sleeves towards each other, so that post 57 moves into the hub 62, aligning the rib 56 with any pair of diametrically opposing grooves 61. At the same time, the sleeve 50 circumferentially covers the sleeve 52 forming a secure attachment of the writing tablet 14 to the attachment means 12.

When position of the writing tablet 14 needs to be changed, the tablet is slightly elevated, disengaging the rib 56 from the grooves 61, the tablet 14 is rotated while post 57 continues to be engaged within the hub 62, and then lowered back into the grooves 61, locking the tablet 14 in a new position.

Figure 3:
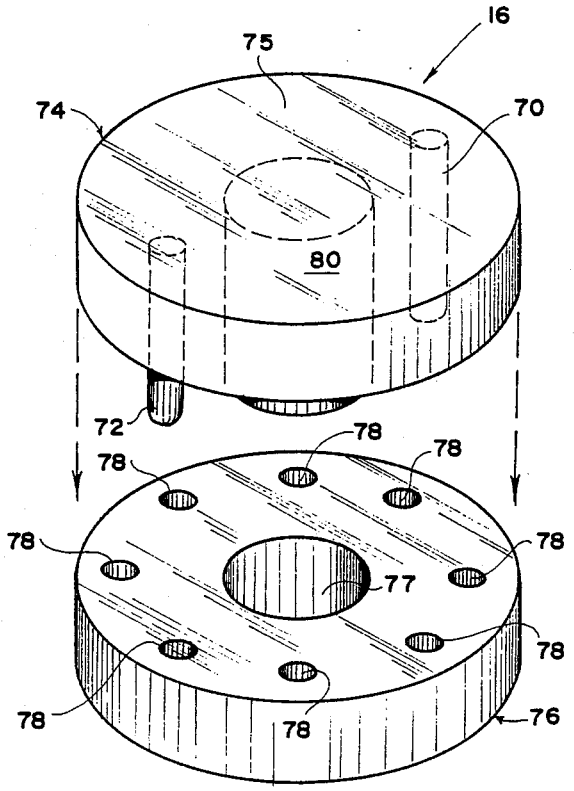
FIG. 3 is an exploded view showing another embodiment of the adjustable means for securing writing tablet to the clipboard attachment means.

Alternatively, the adjustment means, as shown in FIG. 3, can have a pair of pins 70, 72 extending from the bottom of the cylindrical sleeve 74 attached to the tablet 14, with the pins 70, 72 being diametrically opposing to each other. The cylindrical sleeve 76 attached to the belt 18, specifically the bottom thereof, is provided with a plurality of indentations 78, deep enough to house at least a portion of the pins 70, 72 of the cylindrical sleeve 74.

In this manner, the pins 70, 72 can be secured in the diametrically opposing indentations 78, which are equidistantly spaced adjacent the periphery of the cylindrical sleeve 76 to secure the writing tablet 14 in the predetermined position.

A central post 80 attached to the bottom 76 of the sleeve 74 is moved for engagement with a central opening 77 formed in the body of the sleeve 76 and, being of a greater vertical dimension than the opening 77 does not allow the sleeve 74 to be disengaged from the sleeve 76 during rotation of the sleeve 74 when the sleeve 74 is slightly lifted to change position of the writing tablet 14 in relation to the belt 18.

When position of the writing tablet 14 needs to be changed, it is slightly lifted, disengaging the pins 70, 72 from the indentations 78 and rotated, until it reaches the new position, then lowered in the direction of the belt 18, with the pins 70, 72 again engaging the indentations 78 of the cylindrical sleeve 76. It should be noted that diameter of the post 80 is smaller than the diameter of the opening 77, so that it freely rotates within the opening 77.

It will be easily understood to those skilled in the art that other types of locking mechanisms can be employed to allow for the change of position of the writing tablet 14 in relation to the belt 18.

One of the stretchable bands 38 or 40 can be used for securing writing or drawing instruments, such as pens, pencils or rulers to the writing tablet 14, by simply sliding the writing and drawing instruments underneath the stretchable elastic bands 38 or 40, which will then press the writing instruments to the writing tablet 14 and prevent accidental loss of the instruments during transportation of the clip board 10.

Figure 4:
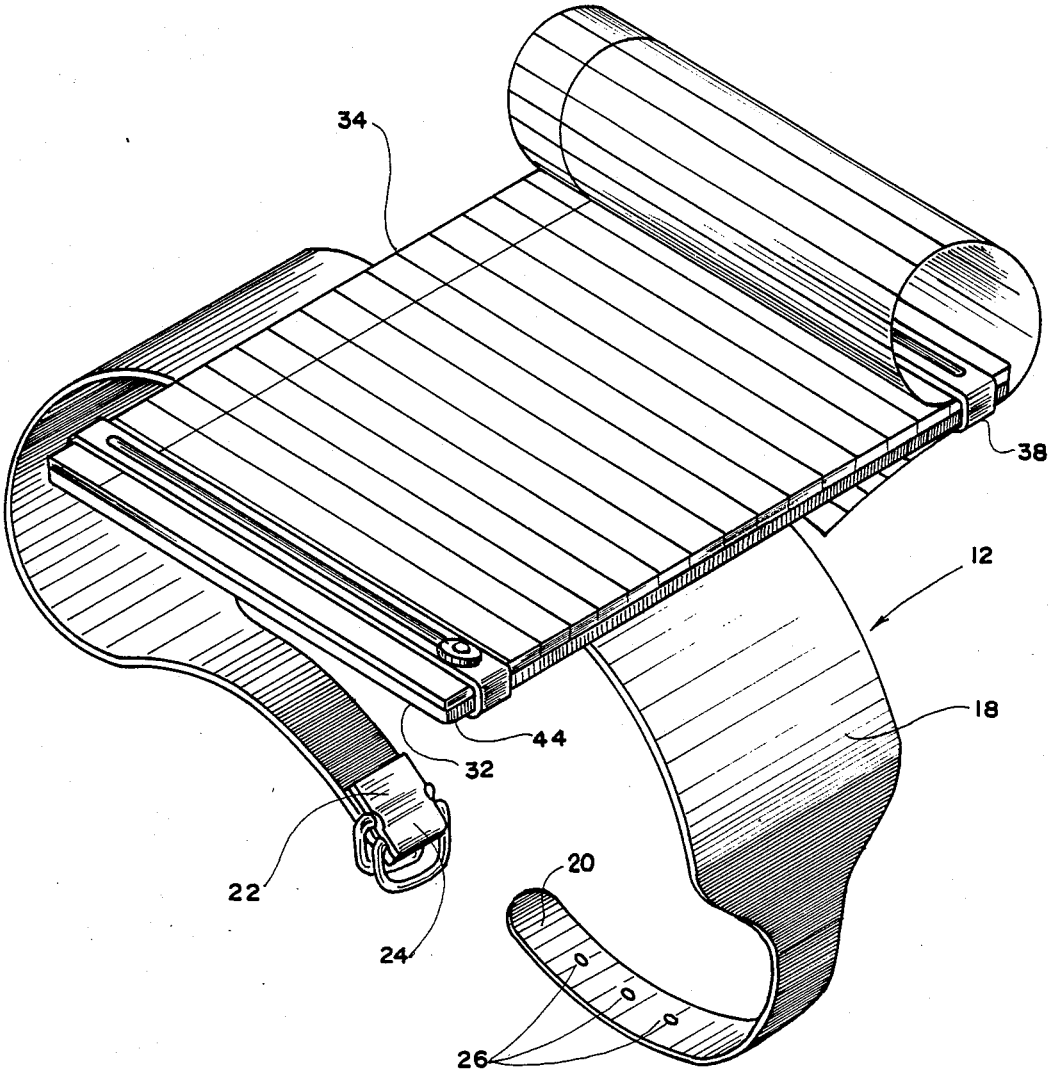
FIG. 4 is a perspective view of the clip board with a note pad attached.

When the user needs to utilize a note pad and it is desirable to secure the turned over leaf, while allowing writing on the next page, the user will simply fold the leaf over the top portion 30 of the clip board 14 and slide the folded sheet of paper under the band 38, beneath the clip board 14, between the rear surface 29 and the band 38 as is shown in FIG. 4.

In this manner, the sheet of paper is secured and does not intervene with continuous writing on the next page of the note pad. The stretchable band 40 can be secured to the top surface 28 of the writing tablet 14, without wrapping about the rear surface 29 of the writing tablet 14, thus securing the bottom portion of the sheet of paper in the same manner, as if the band 40 had a continuous form.

The adjustment means 16 are preferably made thin, so as not to interfere with writing and make the clip board 10 cumbersome in use.

The clip board 10 can be manufactured from scratch-resistant, high impact plastic, lightweight metal or pressed paperboard, although any other similar material can be used.

The bands 38 and 40 can be made of transparent material to allow visual inspection of the paper secured by the bands.

Many other modifications and changes can be readily made by those skilled in the art, without departing from the spirit and scope of this invention. Therefore, I pray that my rights to the invention be limited only by the spirit and scope of the appended claims.

I claim:

1. A combination consisting essentially of a clip board and a note pad for positioning on the clip board, said note pad having substantially equal width with said clip board for holding the note pad during writing, comprising:

a writing tablet means having a front surface for positioning said note pad thereon and a rear surface, a top portion and a bottom portion wherein said note pad has a plurality of sheets of paper and is substantially the same width as said clip board;

means for securing the note pad on the front surface of the clip board, wherein said means for securing note pad comprises a continuous stretchable band wrapped about the front and rear surfaces of the writing tablet means, wherein said stretchable band secures the sheets of paper folded over the top of the clip board on the rear surface of the writing tablet means;

an attachment means for detachably securing the writing tablet menas to a thigh of a user; and means for selectively positioning the writing tablet means in relation to the attachment means and locking the writing tablet means in a selected position.

2. The device of claim 1, wherein said means for securing paper comprises a pair of holder elements, pivotally mounted at opposite corners of the writing tablet means and movable between a first position, securing paper at the top and bottom portions of the writing tablet means, and a second position substantially perpendicular to the first position, securing paper along sides of the writing tablet means.

3. The device of claim 1, wherein said attachement means comprises a belt securable to the rear surface of the writing tablet means adjacent its middle portion and having locking means on opposite ends thereof, said belt adapted for wrapping about the user's thigh, thereby securing position of the clip board.

4. The device of claim 3, wherein said locking means comprises a buckle.

5. The device of claim 1, wherein said means for selectively positioning the writing tablet means comprise a first cylindrical sleeve having a closed bottom fixedly attached to the rear surface of the writing tablet means, a second cylindrical sleeve of a diameter smaller than the first sleeve, said second sleeve having a closed bottom fixedly attached to the attachment means, said second sleeve being rotationally engageable in relation to said first sleeve, the bottom of said first sleeve having a diametrical rib extending outwardly therefrom, the bottom of the second sleeve having a plurality of diametrical grooves adapted for receiving the diametrical rib therein for securing position of the writing tablet means in relation to said attachment means.

6. The device of claim 5, wherein said first sleeve is provided with a central post and said second sleeve is provided with a central hub having an opening therein, a diameter of the hub opening being greater than a diameter of the post to allow for free rotational movement of the hub within the central opening within which the hub is engaged.

7. The device of claim 6, wherein said hub has a vertical dimension slightly greater than a vertical dimension of the central opening and a vertical dimension of the diametrical rib, so that disengagement of the first sleeve from the second sleeve is prevented, while allowing disengagement of the rib from the diametrical groove.

8. The device of claim 1, wherein said means for selectively positioning the writing tablet means comprises a first cylindrical sleeve having a closed bottom fixedly attached to the rear surface of the writing tablet means, a second cylindrical sleeve of a diameter smaller than the first sleeve, said second sleeve having a closed bottom fixedly attached to the attachment means, said second sleeve being rotationally engageable in relation to said first sleeve, the bottom of said first sleeve having a pair of diametrically opposed pins extending outwardly therefrom, the bottom of the second sleeve having a plurality of equidistantly spaced indentations adapted for receiving the diametrically opposed pins therein for securing position of the writing tablet means in relation to said attachment means.

9. The device of claim 8, wherein said first cylindrical sleeve is provided with a central post extending perpendicularly therefrom, and said second sleeve is provided with a central opening having a diameter greater than diameter of the central post to allow for free rotational movement of the first cylinder in relation to the second cylinder.

10. The device of claim 9, wherein said post has a vertical dimension greater than the vertical dimension of the central opening and a vertical dimension of the pins, so that disengagement of the first sleeve from the second sleeve is prevented, while allowing disengagement of the pins from respective indentations made in the second sleeve.

* * * * *